US008425210B2

(12) United States Patent
Armenio et al.

(10) Patent No.: US 8,425,210 B2
(45) Date of Patent: Apr. 23, 2013

(54) TWO-SETTING VARIABLE-ECCENTRICITY VANE PUMP

(75) Inventors: Giacomo Armenio, Livorno (IT); Bernardo Celata, Livorno (IT)

(73) Assignee: Pierburg Pump Technology Italy S.p.A., Lanciano (IT)

( * ) Notice: Subject to any disclaimer, the term of this patent is extended or adjusted under 35 U.S.C. 154(b) by 860 days.

(21) Appl. No.: 11/997,636

(22) PCT Filed: Aug. 1, 2006

(86) PCT No.: PCT/IB2006/002085

§ 371 (c)(1),
(2), (4) Date: Oct. 15, 2009

(87) PCT Pub. No.: WO2007/015135

PCT Pub. Date: Feb. 8, 2007

(65) Prior Publication Data

US 2010/0086423 A1 Apr. 8, 2010

(30) Foreign Application Priority Data

Aug. 2, 2005 (IT) ..... TO2005A0543

(51) Int. Cl.

| | |
|---|---|
| ***F01C 20/18*** | (2006.01) |
| ***F01C 20/22*** | (2006.01) |
| ***F04C 14/18*** | (2006.01) |
| ***F04C 14/22*** | (2006.01) |

(52) U.S. Cl.

USPC ..... 418/29

(58) Field of Classification Search ..... 418/22–27, 418/29, 31

See application file for complete search history.

(56) References Cited

U.S. PATENT DOCUMENTS

| | | | | |
|---|---|---|---|---|
| 3,771,921 | A * | 11/1973 | Rohde et al. | 418/26 |
| 4,035,105 | A * | 7/1977 | Dantlgraber | 418/26 |
| 4,222,718 | A * | 9/1980 | Lemke | 418/26 |

(Continued)

FOREIGN PATENT DOCUMENTS

| | | | |
|---|---|---|---|
| DE | 4115894 | A1 | 11/1992 |
| GB | 2151705 | A | 7/1985 |
| JP | 57157083 | A | 9/1982 |

OTHER PUBLICATIONS

Hilbert J.-M., "Pompes a palettes autoregulatrices PVS a compensation hydraulique des jeux", Energie Fluide, Jan. 1989, pp. 4-8, vol. 28, No. 1, CFE, Paris, France.

International Search Report, PCT/IB2006/002085, Dec. 27, 2006.

*Primary Examiner* — Mary A Davis

(74) *Attorney, Agent, or Firm* — Robert P. Lenart, Esq.; Pietragallo Gordon Alfano Bosick & Raspanti, LLP

(57) ABSTRACT

A variable-eccentricity vane pump having a rotor fitted with blades; an adjusting ring housing the rotor; elastic means for forcing the adjusting ring into a maximum-eccentricity position with respect to the rotor; a first sliding member connected to the adjusting ring and which slides in fluidtight manner inside a first chamber connected hydraulically to a delivery conduit of the pump; and a second sliding member connected to the adjusting ring and which slides in fluidtight manner inside a second chamber connected hydraulically to a delivery conduit of the pump. The first sliding member is connected to the adjusting ring on the opposite side to the elastic means and the second sliding member; and the second chamber is smaller than the first chamber, and has a drain opening formed in a lateral wall on which the second sliding member slides.

4 Claims, 1 Drawing Sheet

U.S. PATENT DOCUMENTS 4,325,215 A * 4/1982 Yamamoto ..... 418/27
4,780,069 A * 10/1988 Dantlgraber et al. ..... 418/26
4,950,137 A * 8/1990 Fischer et al. ..... 418/26
5,236,319 A 8/1993 Fischer et al.

* cited by examiner

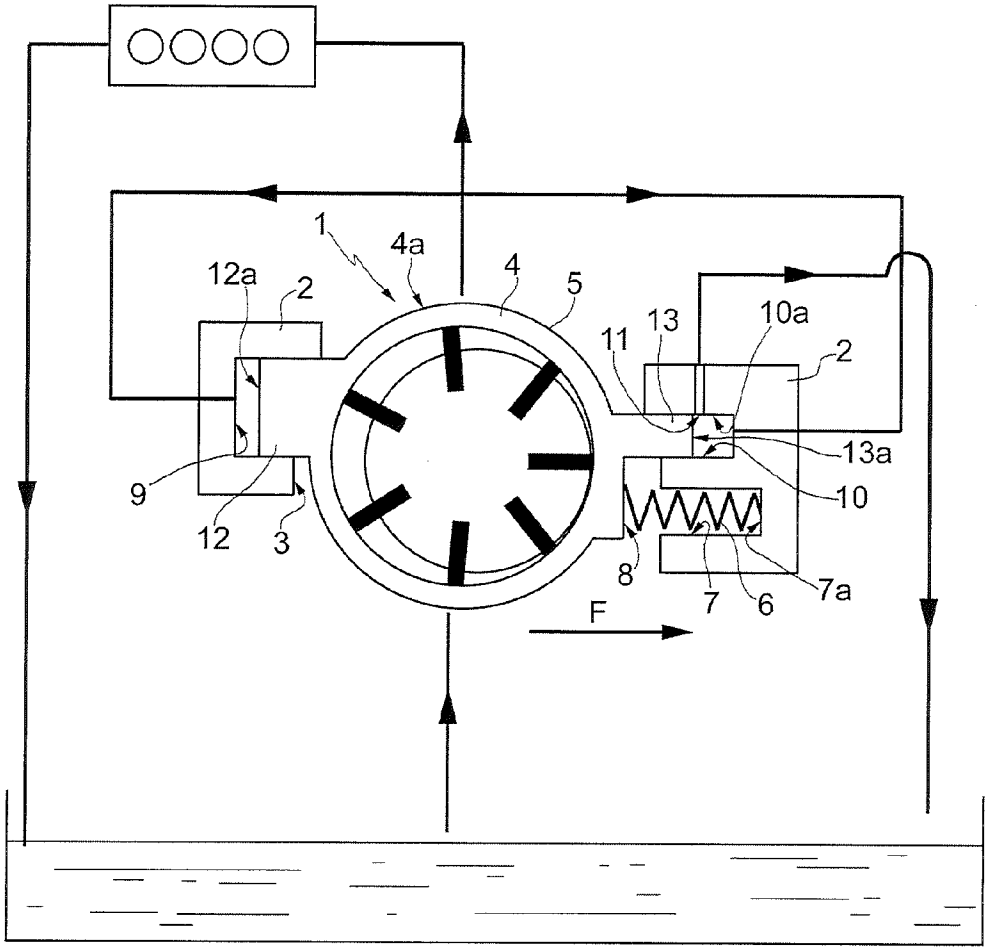
1
4a
4
5
2
10a
13
11
13a
10
2
7a
6
7
8
F
3
12
12a
9

TWO-SETTING VARIABLE-ECCENTRICITY VANE PUMP

CROSS-REFERENCE TO RELATED APPLICATIONS

This application is a U.S. National Stage Application under 35 U.S.C. Section 371 of PCT International Application No. PCT/IB32006/002085, filed Aug. 1, 2006, which is incorporated herein by reference as if set forth in its entirety.

TECHNICAL FIELD

The present invention relates to a two-setting, variable-eccentricity vane pump. More specifically, the pump according to the present invention provides for pumping lubricating oil to an internal combustion engine, to which specific reference is made in the following description purely by way of example.

BACKGROUND ART

As is known, variable-eccentricity vane pumps have only one delivery pressure setting, which means the pump, particularly at high speed, supplies oil at pressures higher than those actually required by the engine.

To eliminate this drawback, devices have been designed to substantially continuously adjust operation of the pump. Though successful in solving the above problem, such devices employ electronic central control units which make them both expensive and fragile.

DISCLOSURE OF INVENTION

It is an object of the present invention to provide a pump designed to provide a straightforward, low-cost solution to the problems of the known state of the art.

According to the present invention, there is provided a variable-eccentricity vane pump comprising a rotor fitted with blades; an adjusting ring housing said rotor; and elastic means for forcing said adjusting ring into a maximum-eccentricity position with respect to said rotor; said pump being characterized by comprising a first sliding member connected to said adjusting ring and which slides in fluidtight manner inside a first chamber connected hydraulically to a delivery conduit of the pump; and a second sliding member connected to said adjusting ring and which slides in fluidtight manner inside a second chamber connected hydraulically to a delivery conduit of the pump; said first sliding member being connected to said adjusting ring on the opposite side to said elastic means and said second sliding member; and said second chamber being smaller than said first chamber, and comprising a drain opening formed in a lateral wall on which said second sliding member slides.

BRIEF DESCRIPTION OF THE DRAWING

A non-limiting embodiment of the invention will be described by way of example with reference to the accompanying drawing, which shows a cross section, with parts removed for clarity, of the pump according to the present invention.

BEST MODE FOR CARRYING OUT THE INVENTION

Number 1 in the accompanying drawing indicates as a whole the variable-eccentricity vane pump according to the present invention. Pump 1 comprises, in known manner, a main body 2 having a cavity 3; an adjusting ring 4 housed inside cavity 3, in which it can translate as described below; and a rotor 5 fitted with blades (not shown), housed inside adjusting ring 4, and having an axis of rotation fixed with respect to main body 2.

As is known, by varying the eccentricity between rotor 5 and adjusting ring 4, the delivery of pump 1 can be regulated as required by a user device (not shown) located downstream from pump 1 and defined, in the example shown, by an internal combustion engine.

As shown in the drawing, pump 1 comprises a preloaded spring 6 compressed between a wall 7*a* of a seat 7 formed in main body 2, and a wall 8 defined on an outer surface 4*a* of adjusting ring 4. Positioned as described above, spring 6 forces adjusting ring 4 into a maximum-eccentricity position with respect to rotor 5 and, hence, into a condition in which oil delivery by pump 1 is maximum.

As shown in the drawing, pump 1 comprises a first chamber 9 and a second chamber 10, both formed in main body 2 and facing each other inside cavity 3. Each chamber 9, 10 is connected to a conduit for feeding oil from pump 1 to the engine. More specifically, chamber 10 is connected to an oil tank by a drain opening 11 formed in a lateral wall 10*a*, and is formed in the same part of main body 2 as seat 7 of spring 6.

As shown in the drawing, pump 1 comprises a first sliding member 12 and a second sliding member 13, both formed in one piece with adjusting ring 4, and which slide in fluidtight manner inside first chamber 9 and second chamber 10 respectively. More specifically, each sliding member 12, 13 has a respective work surface 12*a*, 13*a*, on which the pressure of the oil supplied by the pump and present inside respective chamber 9, 10 exerts a force to move sliding member 12, 13.

In actual use, starting with rotor 5 and adjusting ring 4 set to the maximum-eccentricity position by spring 6, the speed of the rotor is increased, thus increasing the pressure of the oil supplied by the pump. The increase in oil pressure produces an increase in pressure in chamber 9, so that force is exerted on surface 12*a* of sliding member 12. In chamber 10, on the other hand, drain opening 11 prevents the pressure from increasing, so that no force is exerted on sliding member 13.

In the above condition, when the force of the pressure on surface 12*a* exceeds the opposing force of spring 6, adjusting ring 4 is moved in the direction indicated by arrow F, thus reducing the eccentricity with respect to rotor 5.

As adjusting ring 4 moves, a position is eventually reached in which sliding member 13 closes drain opening 11.

In the above condition, to move adjusting ring 4 further, the pressure in chamber 9 must generate enough force to counteract not only the force of spring 6 but also the force exerted on surface 13*a* by the pressure generated in chamber 10, which is smaller than chamber 9. In chamber 10, in fact, the pressure tends to increase, on account of oil drainage through opening 11 being prevented.

In other words, as the pressure of the oil supplied by pump 1 increases, adjusting ring 4 moves in the direction of arrow F according to two different, consecutive laws. That is, the movement of adjusting ring 4 is first opposed solely by spring 6, and then also by the force exerted on surface 13*a* by the oil pressure in chamber 10.

The pump according to the present invention provides for achieving oil supply as close as possible to the actual demand of the engine, and, at the same time, unlike known solutions, is extremely straightforward and cheap to produce.

The invention claimed is:

1. A variable-eccentricity vane pump (1) comprising a rotor (5) fitted with blades; an adjusting ring (4) housing said rotor (5); and elastic means (6) for forcing said adjusting ring (4) into a maximum-eccentricity position with respect to said rotor (5); said pump being characterized by comprising a first sliding member (12) connected to said adjusting ring (4) and which slides in fluidtight manner inside a first chamber (9) connected hydraulically to a delivery conduit of the pump; and a second sliding member (13) connected to said adjusting ring (4) and which slides in fluidtight manner inside a second chamber (10) connected hydraulically to a delivery conduit of the pump; said first sliding member (12) being connected to said adjusting ring (4) on the opposite side to said elastic means (6) and said second sliding member (13); and said second chamber (10) being smaller than said first chamber (9), and comprising a drain opening (11) formed in a lateral wall (10*a*) on which said second sliding member (13) slides.

2. A pump as claimed in claim 1, characterized in that said first sliding member (12) and said second sliding member (13) are formed in one piece with said adjusting ring (4).

3. A pump as claimed in claim 1, characterized by comprising a main body (2), in which are formed a cavity (3) housing said adjusting ring (4), and said first (9) and second (10) chamber facing each other inside said cavity (3).

4. A pump as claimed in claim 3, characterized in that said elastic means comprise a preloaded spring (6) compressed between a wall (7*a*) of a seat (7) formed in said main body (2), and a wall (8) defined on an outer surface (4*a*) of the adjusting ring (4).

* * * * *